US005819381A

United States Patent [19]

Lake

[11] Patent Number: 5,819,381

[45] Date of Patent: Oct. 13, 1998

[54] APPARATUS FOR GRIPPING THIN FLEXIBLE MATERIALS, SUCH AS CLOTH

[75] Inventor: Micheal D. Lake, Barrington, Ill.

[73] Assignee: Robert C. Bosack, Orland Park, Ill.

[21] Appl. No.: 3,231

[22] Filed: Jan. 11, 1993

Related U.S. Application Data

[63] Continuation-in-part of Ser. No. 803,175, Dec. 5, 1991, Pat. No. 5,177,813.

[51] Int. Cl.[6] ..... A44B 21/00

[52] U.S. Cl. ..... 24/564; 24/541; 24/562; 2/336; 2/340

[58] Field of Search ..... 2/333, 336, 107, 2/112, 117, 223, 229, 300, 303, 306, 323, 325, 326, 330, 332, 334, 335, 340; 24/507, 541, 562, 564, 303, 306, 489

[56] References Cited

U.S. PATENT DOCUMENTS

| | | | |
|---|---|---|---|
| 685,983 | 11/1901 | Gutmann | 24/507 |
| 2,401,413 | 6/1946 | Colwell . | |
| 2,766,500 | 10/1956 | Chanko | 24/507 X |
| 3,780,402 | 12/1973 | Takabayashi . | |
| 3,914,828 | 10/1975 | Noda . | |
| 4,005,510 | 2/1977 | Noda . | |
| 4,084,299 | 4/1978 | Noda . | |
| 5,177,813 | 1/1993 | Bosack et al. . | |

*Primary Examiner*—Jeanette E. Chapman
*Attorney, Agent, or Firm*—Wallenstein & Wagner, Ltd.

[57] ABSTRACT

A gripping apparatus, and more specifically a gripping apparatus that can be used with a shirttail retaining harness to grip garments and secure them in place without damaging the garments. The gripping apparatus 30 comprises an upper member 34 having a substantially flat, elastic upper surface 32 and a lower member 38 having a substantially non-flat, rigid lower surface 36. When the gripping apparatus is in a closed position to grip a garment, the lower member 38 is urged into contact with the upper member 34, such that the lower surface 36 elastically deforms the upper surface 32.

10 Claims, 1 Drawing Sheet

FIG. 2
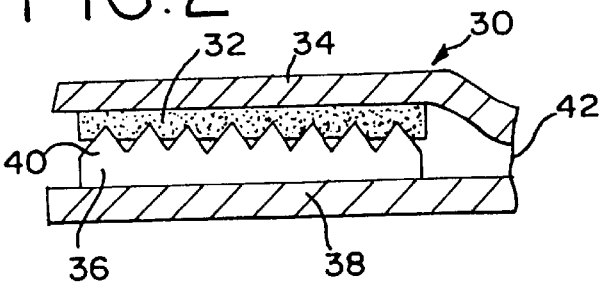
FIG. 1
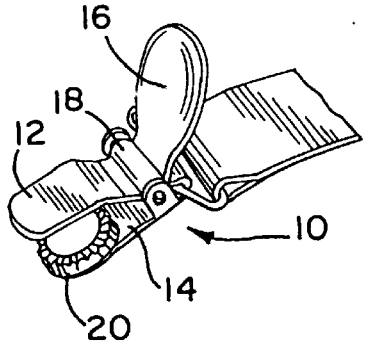
FIG. 3
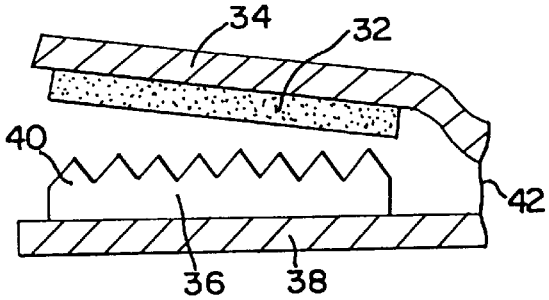
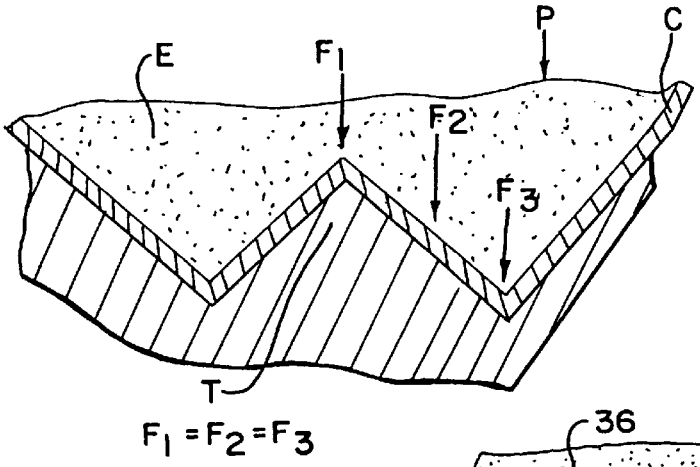
FIG. 4
FIG. 5
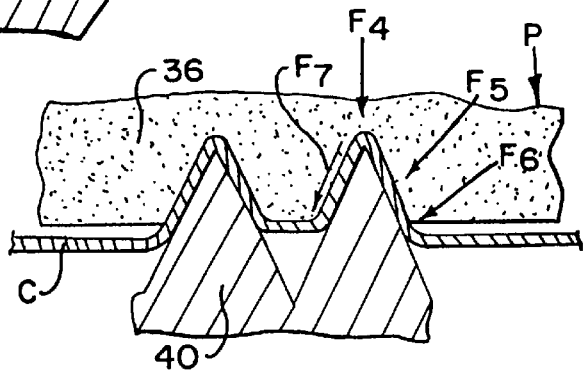
$F_4 > F_5 > F_6$
$F_4 > F_1, F_2, F_3$
$F_5 > F_1, F_2, F_3$
$F_6 \cong F_1, F_2, F_3$

APPARATUS FOR GRIPPING THIN FLEXIBLE MATERIALS, SUCH AS CLOTH

RELATED APPLICATION

The present application is a continuation-in-part of U.S. application Ser. No. 07/803,175, filed on Dec. 5, 1991, now as U.S. Pat. No. 5,177,813. Jan. 12, 1993.

TECHNICAL FIELD

The present invention relates generally to an apparatus for gripping thin flexible materials, such as gripping cloth or fabric in connection with a garment suspender or a shirttail retaining harness.

BACKGROUND OF THE INVENTION

There are numerous instances where there is a need to temporarily secure thin flexible materials, such as cloth. In such instances, various devices may be employed, all of which may include means capable of gripping the material. For example, such gripping devices can be used with suspenders to hold up trousers, with straps for securing corners of bed sheets to a mattress, with straps for securing tent flaps in a desired position, for flag attachments, with shirttail retaining harnesses, etc. In these applications, there is a risk of damaging the thin flexible material when using conventional gripping devices, since these gripping devices retain the material by urging rigid, jagged members together to clamp or grip the material. Clamping by these gripping devices can pierce the material, and when the material is pulled during use these conventional devices can tear the material. In addition, in a conventional gripping device having upper and lower jagged members that clamp or grip, the construction of the members requires undue and costly manufacturing precision where the members have interdigitating teeth that must fit together in precise alignment.

In an effort to diminish the danger of ripping or damaging material, while at the same time providing added friction for effective gripping, others have employed the use of resilient coatings on the teeth of gripping devices or have provided gripping projections made of resilient material, such as rubber. For example, U.S. Pat. No. 3,914,828 to Noda discloses a clip to be worn with an article of clothing comprised of first and second members each having a jaw. The jaw of the first member has a resilient pad with a waved surface and the jaw of the second member has a plurality of projections each having an inclined face. Although Noda recognizes the problems associated with securely holding a garment in place, it has deficiencies. Since both of the jaws of the Noda device have surfaces with protrusions, there is added manufacturing effort in assembling the jaw surfaces of this clip and ensuring proper alignment of the waved surface and the projections. Furthermore, there are extra manufacturing costs associated with molding the resilient surface into the form of a wave. Because the teeth are apparently interdigitated, it is noted that the effectiveness of the clamping force applied is limited by the effectiveness of the mechanical clip. As soon as the mechanical clip weakens of wears, the gripping action is diminished. This is also becomes a problem when the manufacture of the mechanical means is not within effective manufacturing tolerances. Thus, the jaws do not use the entire advantage of the elastic forces available in an elastic surface.

U.S. Pat. Nos. 4,084,299 and 4,005,510, also to Noda both disclose a plastic clip for suspenders. The clip has gripping means either in the form of auxiliary clipping means which may be comprised of an anti-slipping member of rubber or the like, or resilient pads which may be replaced by projections formed integrally with the base plates. However, this clip has deficiencies. Since both of the surfaces of the gripping means are formed in a wavy non-flat shape, again there is unnecessary difficulty in the molding, manufacture and assembly of the surfaces of this clip. Again, the jaws do not use the entire advantage of the elastic, compressive and stretching forces provided by the elastic surface as a result of interdigitation.

The above deficiencies are also present in the devices disclosed in U.S. Pat. No. 3,780,402 to Takabayashi and Colwell. As Takabayashi discloses the surface of auxiliary clip members being provided with a number of slots in a direction transverse to the longitudinal direction of the clip members for preventing slip and Colwell provides the gripping surfaces with mating saw-toothed or otherwise roughened surfaces.

Thus, there is a need for a gripping device that holds garments securely in place, that protects garments from rips, tears or other damage and that is easier and less expensive to manufacture, and that wears longer.

The present invention meets these needs and overcomes the deficiencies associated with the prior art by providing an improved gripping apparatus that in one application, can be used with conventional devices such as a shirttail retaining harness as disclosed in U.S. Pat. No. 5,177,813. The gripping apparatus of the present invention allows for less restrictive manufacturing tolerances, requires less molding, is easier to assemble, and has a longer effective life than prior devices.

SUMMARY OF THE INVENTION

The present invention is directed to an improved gripping apparatus comprised of a first jaw having a substantially non-flat and relatively rigid surface, preferably comprising protruding teeth, and a second jaw having a substantially flat and elastic surface, preferably comprising an elastomeric or rubber material. When the gripping apparatus of the present invention is in a closed position, the rigid surface is urged into contact with the elastic surface, such that the elastic surface is elastically deformed around the non-flat or protruding surface of the first jaw. In the preferred embodiment, the cloth of a garment is frictionally engaged by the rubber which elastically squeezes the cloth against the teeth of the mating jaw without damaging the garment. The elastic, compressive, and stretching forces that occur when the non-flat rigid surface is urged into contact with the substantially flat, elastic surface provides a stronger gripping load, with little, if any damage to the thin flexible material.

One object of the invention is to provide, wide variation in the choice of the protruding members of the second jaw. For example, the protruding members may be rounded or jagged, may be randomly oriented or in any fixed configuration such as linear or circular rows. Because the mating surface is a flat elastic surface, there is no need for the manufacturing precision required with matching upper and lower projections especially, e.g., interdigitated teeth.

According to one aspect of the invention, effective gripping is maintained over a wider range of load provided by the mechanical or spring action of the jaws due to the fact that protrusion of the teeth into the flat surface maintains an elastic force even when the jaws become somewhat loose due to wear or mismanufacture.

Other advantages and aspects of the present invention will become apparent upon reading the following description of the drawings and the detailed description of the invention and preferred embodiment of the invention.

BRIEF DESCRIPTION OF THE DRAWINGS

FIG. 1 is a perspective view of a prior art garment clasp or gripping apparatus;

FIG. 2 is a cross-sectional view of a preferred embodiment of the gripping apparatus of the present invention showing cooperative surfaces of the gripping apparatus with jaws thereof in a closed position for holding a garment;

FIG. 3 is a cross-sectional view of the gripping apparatus of FIG. 2 showing the two surfaces of the gripping apparatus out of contact with each other;

FIG. 4 is a force vector diagram showing the forces at work when interdigitating teeth of a prior art gripping apparatus are urged into contact to hold a garment; and, FIG. 5 is a force vector diagram showing the forces at work when the flat, elastic surface and non-flat, rigid surface of the gripping apparatus of FIG. 2 are urged into contact to hold a garment.

DETAILED DESCRIPTION OF THE INVENTION

While this invention is susceptible of embodiment in many different forms, there is shown in the drawings and will herein be described in detail, preferred embodiments of the invention. The present disclosure is to be considered as an exemplification of the principles of the invention and is not intended to limit the broad aspects of the invention to the embodiment illustrated. One application of the present invention is disclosed in U.S. Pat. No. 5,177,813, the specification of which is incorporated herein by reference.

FIG. 1 shows a conventional garment clasp 10 which includes an upper jaw 12, a lower jaw 14 and a closer lever 16 which provides a fulcrum 18 to close and lock the jaws 12 and 14 together, as is known in the art. The fulcrum 18 can also function as a flat spring to provide a constant mechanical gripping load. A circular row of teeth 20 are provided on the lower jaw 14. A circular row of teeth (not shown) are provided on the upper jaw 16. The teeth on the upper jaw 14 and lower jaw 16 interdigitate so as to mesh with each other when the jaws 12 and 14 are in a closed position to grip the material.

FIG. 2 is a cross-sectional view of a gripping apparatus 30 of the present invention in a closed position showing a novel modification of a surface of the gripping apparatus 10. The gripping apparatus 30 of FIG. 2 is similar to the clasp 10 of FIG. 1, except that an upper surface 32 of an upper jaw 34 is a flat layer of substantially elastic material. The elastic material can be any form of elastomeric material such as rubber. A lower surface 36 of a lower jaw 38 is a non-flat layer of substantially rigid material, such as metal or rigid plastic. FIG. 2 shows the lower surface 36 has a single row of teeth 40 along the length of the lower member 38, rather than with a circular row of teeth. However, it should be appreciated that the lower surface 36 of lower member 38 may have various configurations of teeth or protrusions that will provide the advantages disclosed. For example, the lower surface 36 may comprise more than one row of teeth, a plurality of spaced teeth, a wavy configuration, or one or more circular rows of teeth. The gripping apparatus 30 has a means for maintaining the jaws 34 and 38 in a closed position, which is in the form of a conventional closer lever 42 that acts to close and lock and urge the jaws 34 and 38 together.

FIG. 3 is a cross-sectional view of the gripping apparatus of FIG. 2 in an open position showing the upper surface 32 and the lower surface 36 out of contact with each other.

When the gripping apparatus 30 is in a closed position as shown in FIGS. 2 and 5, the protruding teeth 40 of lower surface 36 protrude into the flat, elastic surface 32, so as to elastically deform the elastic surface 32. The cloth C of a shirttail or garment shown in FIG. 5 is gripped between the teeth 40 and the elastic surface 32 when the jaws 34 and 38 are in a closed position. The elasticity of surface 32 squeezes the cloth against the teeth 40 of the mating jaw 38 with little or no damage to the cloth.

FIG. 4 is a force vector diagram showing the forces believed to be at work when solid teeth T of a conventional prior art clasp or clip are urged into interdigitating contact with elastic teeth E in a closed position to grip a garment. A garment C is shown between the interdigitating teeth. F1 represents the force vector working against an uppermost area of contact or the apex of the teeth T by the teeth E. F2 represents the force vector working against a mid-section of the each tooth T by the teeth E. F3 represents the force vector working against a the base of the teeth E and T. When the teeth of the upper and lower jaws of a conventional clasp come into interdigitating contact to grip a garment, the forces along vectors F1, F2 and F3 are believed to be equal at all points along the teeth T and E. Thus, the gripping capabilities of a conventional clasp having upper and lower rows of teeth in interdigitating contact, is primarily a function of the force urging the two jaws into contact. Because little elastic deformation is employed, effective gripping is substantially diminished when the jaws fail to hold the surfaces in close contact. As such, the mechanism providing the force and the jaws must be made to more exacting standards with a higher level of assurance that full force will be applied and that the teeth and jaws match well. This increases the cost of manufacture and materials.

FIG. 5 is a force vector diagram showing the elastic compressive, and stretching forces believed to be at work when the flat, elastic surface 32 and the teeth 40 of the gripping apparatus 30 of FIG. 2 are urged into contact to grip a garment C. F4 represents the force vector working against the apex the teeth 40. F5 represents the force vector working against the mid-section of the teeth 40. F6 represents the force vector working against the lowermost area of contact or the base of the teeth 40. In contrast to FIG. 4, when the teeth 40 of the lower surface 36 are urged into contact with the substantially flat and elastic upper surface 32 to grip a garment the upper surface is substantially deformed elastically. This provides compressive forces which are greatest at the apex or top and lowest at the base or bottom, that is, F4>F5>F6. In addition, it is believed that F6=F1, F2, F3, and F5>F1, F2, F3, and F4>F1, F2, F3 for any given load P. In should also be noted that stretching forces as shown along F7 of FIG. 5 are present.

Importantly, the forces F4, F5 and F7 will still provide effective gripping as the surface 32 and teeth 40 retreat from each other (as shown in FIG. 5) due to wear or relaxed manufacturing tolerances because of the degree of deformation of the surface 32.

The frictional engagement of the cloth in gripping apparatus 30 of the present invention will increase with the number of teeth 40 provided and the degree of protrusion by the teeth into the elastic surface 32. The elastic, compressive, and stretching forces increase as the teeth 40 protrude further into the elastic surface 32. As discussed above, these factors can be altered as desired, that is, the invention contemplates that any configuration of teeth or protrusions will provide a degree of the advantages disclosed. It is believed that the gripping apparatus 30 of the present invention is less likely to damage cloth as the gripping takes place with only one hard element, that is, the teeth 40 or protrusions. It has been found that the configuration of gripping apparatus 30 holds garment material securely with minimal if any damage to the fiber thereof. The gripping apparatus 30 is particularly suitable for gripping thin, flexible, and slick materials such as silk, polyester, linen, wool, plastic or paper. For firmer gripping of materials such as silk, the invention contemplates providing multiple rows of teeth on the lower surface 36 of lower jaw 38 and extending along either the width of the length of the lower jaw 38. Rubber coating of the teeth 40 can also be optionally provided to add to the frictional ability of the gripping apparatus 30 to grip fabric.

Thus, the gripping apparatus 30 having the preferred embodiment of a substantially flat, elastic upper surface 32 and a substantially non-flat, rigid lower surface 36 can be used to grip a variety of lightweight materials with less damage and stretching of the materials than with prior art clasps. However, the gripping apparatus 30 of the present invention, as shown in FIGS. 2 and 3, is not limited to use with shirttail retaining devices. It can also be used to grip such items as bed sheets, table coverings, tent flaps, and the like.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention, should not be limited to such details.

It is claimed:

1. An apparatus for gripping thin flexible material comprising:

a first member having a flat and elastic surface;

a second member having a surface which is sufficiently rigid with respect to said first member surface and having at least one protrusion on said surface of said second member, said protrusion being capable of elastically deforming at least a portion of said substantially flat and elastic surface; and, means for urging said first member into contact with said second member, so that at least a portion of said surface of said first member surface is elastically deformed and so that said thin flexible material between said first and second members is gripped by an elastic force resulting from said elastic deformation.

2. The apparatus of claim 1 wherein said protrusion having an uppermost area and a lowermost area, wherein when said protrusion is urged into contact with said first member surface, elastic, compressive and stretching forces against said protrusion, resulting from said elastic deformation, are strongest at said uppermost area and weakest at said lowermost area of said protrusion.

3. The apparatus of claim 1 wherein said second member surface includes a plurality of protrusions.

4. A gripping apparatus comprising:

a first jaw having a surface which is flat and elastic;

a second jaw having a protrusion which is sufficiently rigid with respect to said first jaw surface to elastically deform at least a portion of said surface first jaw;

means for cooperatively joining said first jaw and said second jaw to provide an open and a close position, wherein said surface of said second jaw is urged into contact with said surface of said first jaw so as to elastically deform said surface of said first jaw when said first jaw and said second jaw are in said closed position; and, means for maintaining said first jaw and said second jaw in said closed position when desired.

5. The apparatus of claim 4 wherein said protrusion on the second jaw being teeth wherein when said second jaw is urged into contact with said first jaw surface, frictional forces against said second jaw are strongest at an uppermost area of contact and weakness at a lowermost area of contact.

6. The apparatus of claim 5 wherein said teeth are circularly arranged in one or more series.

7. The apparatus of claim 1 wherein the protrusion being generally triangular with a generally pointed apex at an uppermost portion thereof.

8. The apparatus of claim 1 wherein the protrusion being generally arcuate at an uppermost portion thereof.

9. The apparatus of claim 3 wherein the protrusions being generally triangular with a generally pointed apex at an uppermost portion thereof.

10. The apparatus of claim 3 wherein the protrusions being generally arcuate at an uppermost portion of each and said protrusions defining a generally wavy surface.

* * * * *

UNITED STATES PATENT AND TRADEMARK OFFICE

CERTIFICATE OF CORRECTION

PATENT NO. : 5,819,381

DATED : October 13, 1998

INVENTOR(S) : Micheal D. Lake

It is certified that error appears in the above-identified patent and that said Letters Patent is hereby corrected as shown below:

Column 1, lines 59-60 delete "clip weakens of wears" and insert -- clip weakens or wears --.
Column 1, lines 60-61, delete "is".

Column 4, lines 20-21, delete "of the" and insert -- of --.
Column 4, line 42, delete "the apex the teeth" and insert -- the apex of the teeth --.

Column 5, line 14, delete "either the width of the length" and insert -- either the width or the length --.

Column 6, line 18, after "said surface" insert -- of said --.
Column 6, line 34, after "contact and " delete "weakness " and insert –weakest--.
Column 6, line 44, delete "uppermost portion thereof" and insert -- uppermost portion of each --.

Signed and Sealed this

Twenty-eighth Day of March, 2000

*Attest:*

Q. TODD DICKINSON

*Attesting Officer*

*Commissioner of Patents and Trademarks*